United States Patent [19]

McKernan et al.

[11] Patent Number: 4,692,984

[45] Date of Patent: Sep. 15, 1987

[54] METHOD OF FORMING HOUSING FOR FREE-STANDING CABINET

[75] Inventors: Thomas J. McKernan, Grand Rapids; Brian Wilcockson, Holland, both of Mich.

[73] Assignee: Haworth, Inc., Holland, Mich.

[21] Appl. No.: 918,623

[22] Filed: Oct. 14, 1986

Related U.S. Application Data

[62] Division of Ser. No. 754,790, Jul. 12, 1985, abandoned.

[51] Int. Cl.[4] ..... B23P 9/00

[52] U.S. Cl. ..... 29/445; 29/469; 29/526 R; 228/142; 228/155; 228/173.6; 228/174; 312/257 R

[58] Field of Search ..... 29/445, 469, 526 R; 228/139, 142, 155, 164, 170, 173.5, 174; 220/71, 4 F, 4 R; 312/257 R, 263, 257 SK, 257 A, 257 SM, 254, 255, 265

[56] References Cited

U.S. PATENT DOCUMENTS

| | | | |
|---|---|---|---|
| 775,894 | 11/1904 | Chidister | 220/71 |
| 1,836,354 | 12/1931 | Abrams | 228/142 |
| 2,002,228 | 5/1935 | Meyercord et al. | 312/257 R |
| 2,438,108 | 3/1948 | Barler et al. | 312/257 R |
| 2,808,309 | 10/1957 | Magester | 312/257 R |
| 3,305,998 | 2/1967 | Deisenroth | 228/142 R |
| 3,341,270 | 9/1967 | Sohl | 312/257 R X |
| 3,517,427 | 6/1970 | Bainter et al. | 29/445 U X |
| 3,816,884 | 6/1974 | Levor | 29/445 X |
| 4,201,428 | 5/1980 | Johnson | 312/257 R |
| 4,224,732 | 9/1980 | Lloyd et al. | 29/445 X |

*Primary Examiner*—Charlie T. Moon

*Attorney, Agent, or Firm*—Flynn, Thiel, Boutell & Tanis

[57] ABSTRACT

An improved housing structure for a large-size free-standing cabinet, and a method of making same. The housing structure employs an upright U-shaped side wall structure joined between top and bottom walls. The side wall structure employs a U-shaped metal skin which is formed in one piece so that the back and side walls are integrally joined together through rounded rear corners, with the front edges of the side walls also being rounded to form front integral edge strips which define the opposite sides of the front opening of the cabinet.

3 Claims, 8 Drawing Figures

METHOD OF FORMING HOUSING FOR FREE-STANDING CABINET

This application is a division of U.S. Ser. No. 754,790, filed July 25, 1985, now abandoned.

FIELD OF THE INVENTION

This invention relates to a free-standing cabinet, such as a lateral file cabinet, and more specifically to an improved housing structure for the cabinet and the method of making same.

BACKGROUND OF THE INVENTION

Most free-standing cabinets of the type utilized in offices, such as lateral file cabinets or wardrobes, employ a housing which generally involves a substantially U-shaped upright side wall structure secured to top and bottom wall structures, with the front of the side wall structure defining a large opening for doors, drawers and the like. Such free-standing cabinets are normally of substantial size, and typically may have a width in the range of 30 to 48 inches, a depth in the range of 16 to 24 inches and a height of up to 6 feet. This size, coupled with the loads imposed on the cabinet, particularly when used for lateral files and the like, requires that the housing structure have substantial strength and rigidity. Such cabinets have typically employed an internal framework which is fabricated from channels, angles and the like, which framework is typically welded. Thereafter the housing is typically provided with an outer skin formed from thin metal plates which are secured, as by welding, to the underlying frame. The skin for the U-shaped upright side wall structure is typically formed from three separate pieces due to the size and fabrication technique of the housing structure, with one large skin being secured to and defining the rear or back wall, and two additional skins being secured to the frame and defining the side walls. This technique normally results in a weld or seam at the rear corners, often due to an overlap between the back and side skins, and in addition normally results in the corners being square. This results in the cabinet having an appearance from the back side which is unsightly, and hence such cabinets typically can be utilized only in situations where the back of the cabinet is directly adjacent a wall or other suitable structure.

Accordingly, the present invention relates to an improved cabinet which is believed to overcome many of the above-mentioned disadvantages. More specifically, this invention relates to an improved housing structure for a large-size free-standing cabinet, such as a lateral file cabinet. The housing structure employs an upright U-shaped side wall structure joined between top and bottom walls. However, the side wall structure employs a U-shaped metal skin which is formed in one piece so that the back and side walls are integrally joined together through rounded rear corners, with the front edges of the side walls also being rounded to form front integral edge strips which define the opposite sides of the front opening of the cabinet. With the improved arrangement of this invention, the cabinet can hence be utilized as a multi-purpose structure, including use in a free-standing open environment whereby the back of the cabinet is exposed but provides a desirable and pleasing appearance due to the back of the cabinet being provided with rounded corners which are free of weld lines or seams.

While small cabinets such as file drawer cabinets of the type attached below desk tops and work surfaces have at times utilized a U-shaped metal skin formed integrally of one piece, nevertheless such skin typically has been formed so as to define the sides and either the top or bottom wall of the cabinet. This configuration has been possible since such drawer units are of rather small size both widthwise and depthwise in contrast to lateral file cabinets, and are also not subjected to the severe loading which exists in lateral file cabinets.

In addition to the use of the integral U-shaped side wall skin on the cabinet of the present invention, as described above, the present invention also provides an interior frame formed from channels which are suitably welded to the skin so as to permit fabrication of the housing structure, whereby when the housing structure is completely fabricated, the channels effectively form two vertically rectangular frames disposed adjacent the front and rear of the cabinet so as to provide it with substantial strength and rigidity. In addition, the housing structure has a top wall which secures to the upper edge of the side wall structure, as by means of removable fasteners, whereby welding of the top to the side wall structure so as to provide additional strength, such as is typical with many of the known structures, is hence not required.

The present invention also provides an improved method for forming and fabricating the housing structure for the cabinet, which method includes the steps of initially providing a large substantially rectangular thin metal plate having the desired dimensions, bending the side edges of the plate to form the front wall edge portions, bending the upper edge of the plate to form a top flange, notching the top flange at four locations corresponding to the four corners of the housing, welding four vertically elongated channels to the inner surface of the sheet while the latter is still in a flat condition, which channels are disposed so that two channels are secured to the inner surface of each of the resulting side walls, and thereafter bending the sheet into its U-shaped configuration by forming rounded bends which create the rear corners of the housing. Bottom rails are then secured to and extend across the U-shaped skin adjacent the lower end thereof, with a bottom plate being welded over the bottom rails. Top rails are positioned to extend between and welded to the upper ends of the vertical channels, and a separately formed top wall or cap is then positioned so as to rest on the top flange and is secured thereto, as by screws or other suitable fasteners.

Other objects and purposes of the invention will be apparent to persons familiar with structures of this type, and methods of fabricating such structures, after reading the following specification and inspecting the accompanying drawings.

Figure 1:
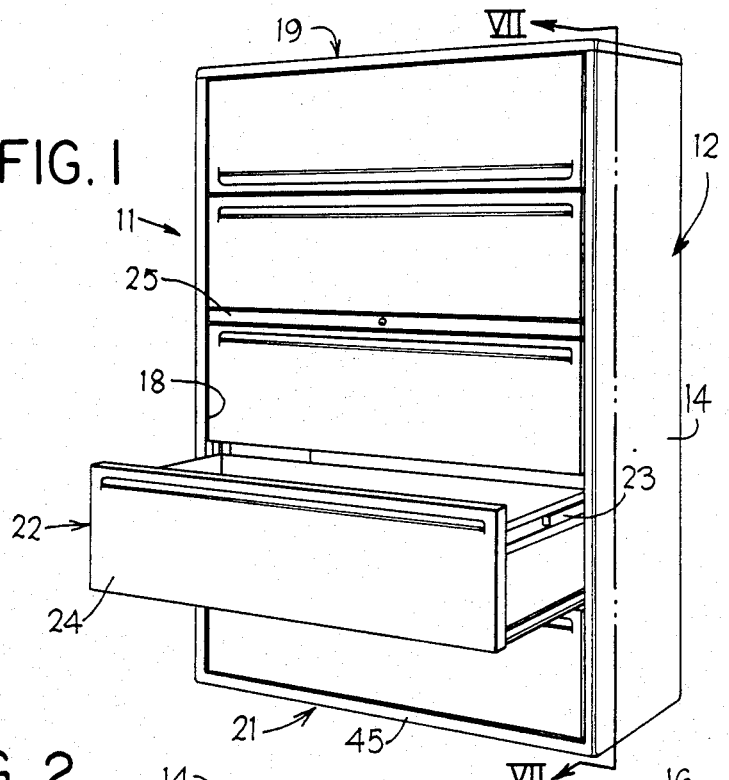
FIG. 1 is a perspective view of a free-standing cabinet according to the present invention.
Figure 5:
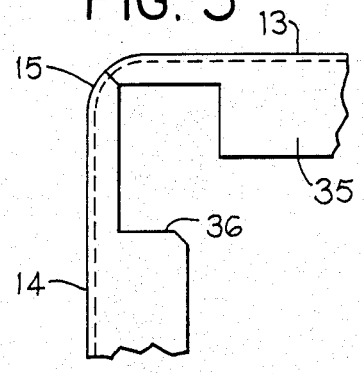
FIG. 5 illustrates the forming of a corner.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to the geometric center of the apparatus and designated parts thereof. Said terminology will include the words specifically mentioned, derivatives thereof, and words of similar import.

DETAILED DESCRIPTION

Referring to FIG. 1, there is illustrated a lateral file cabinet 11 according to the present invention. The cabinet 11 includes a boxlike housing 12 having a substantially planar back wall 13 and opposed substantially parallel side walls 14, the latter being joined to the back wall by small rounded corners 15. The side walls 14, at their forward edges, are rounded at 16 to form the front corners, and there is thus defined a front wall 17 which in reality comprises a pair of small vertically extending edge strips. The front edge strips 17 define a large front opening 18 therebetween. The cabinet is closed at the upper and lower ends by top and bottom structures 19 and 21, respectively.

In the illustrated embodiment, the cabinet 11 supports thereon a plurality of horizontally slidable drawer units 22, which units are supported by conventional telescopic slide devices 23 which connect between the side walls of the housing and the side walls of the drawer unit. The drawer unit 22 has a front wall 24 which, when the drawer unit is in a closed position, is disposed within the front cabinet opening 18 so as to be substantially flush with the front wall 17. The cabinet 11, in the illustrated embodiment, also has a posting shelf 25 supported for horizontal slidable movement thereon, which posting shelf is disposed vertically between two adjacent drawer units. The posting shelf can be replaced by a fixedly mounted filler panel if desired. The overall structure of the drawer units, posting shelf and filler panel, and their mounting on the housing, is described in copending application Ser. No. 733,673 and entitled "LOCK MECHANISM FOR LATERAL FILE", the disclose of which is incorporated herein by reference.

Each side wall 14 of the housing has a pair of hat-shaped channels 26 and 27 fixedly secured, as by welding, adjacent the respective front and rear edges thereof. These channels are fixed to the inner side of the respective side wall and extend vertically throughout substantially the complete length of the housing. The front channel 26 is effectively formed as a double reversely opening channel in that it includes a substantially Z-shaped part 28 which projects forwardly and has the free leg thereof welded to an in-turned flange 29 formed on the free edge of the front wall strip 17. This Z-shaped part 28 defines a vertically elongated channel-like recess or slot 31 which opens inwardly of the cabinet for slidably accommodating a vertically elongated locking bar (not shown).

Figure 4:
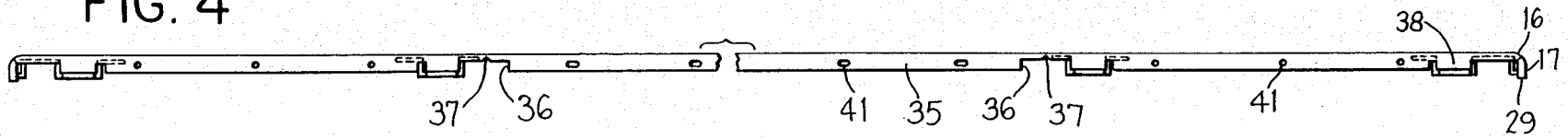
FIG. 4 is a top view of FIG. 3.
Figure 3:
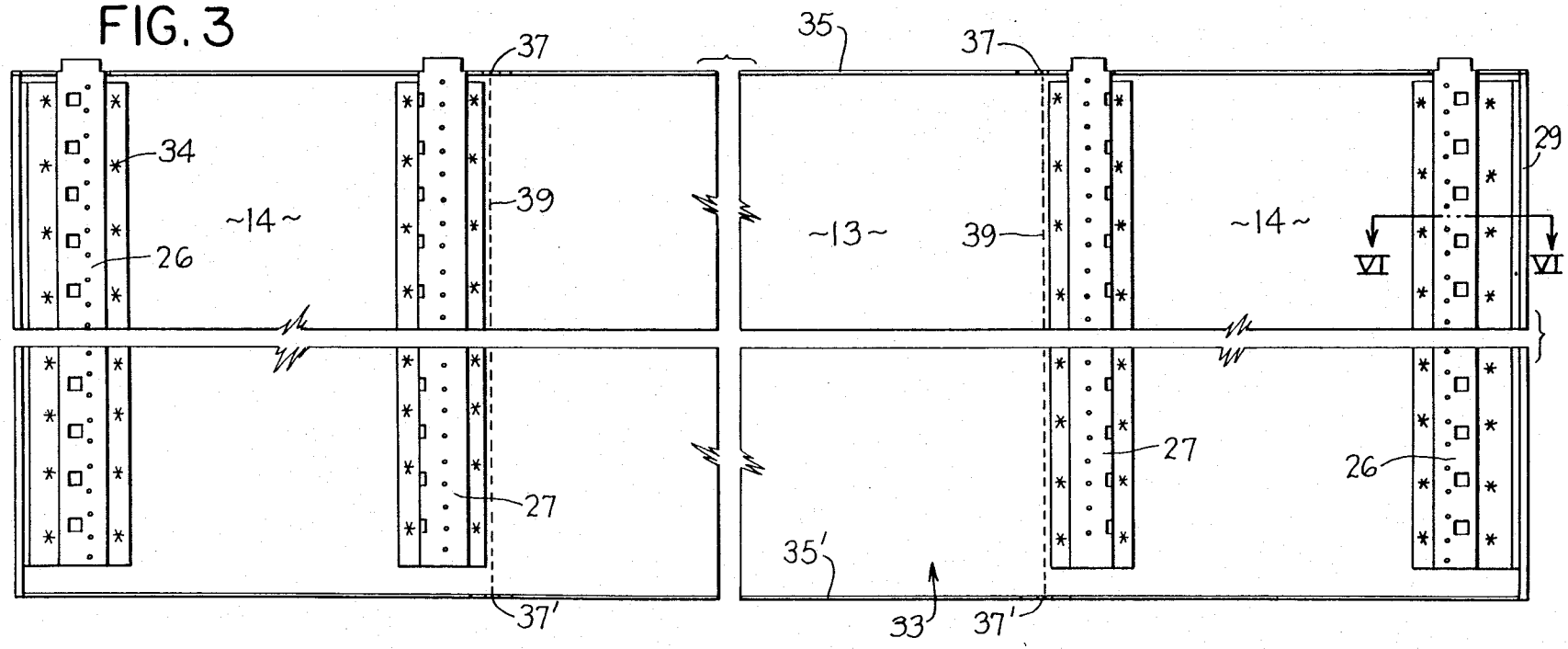
FIG. 3 illustrates the side wall structure partially fabricated but prior to being bent into a U shape.
Figure 7:
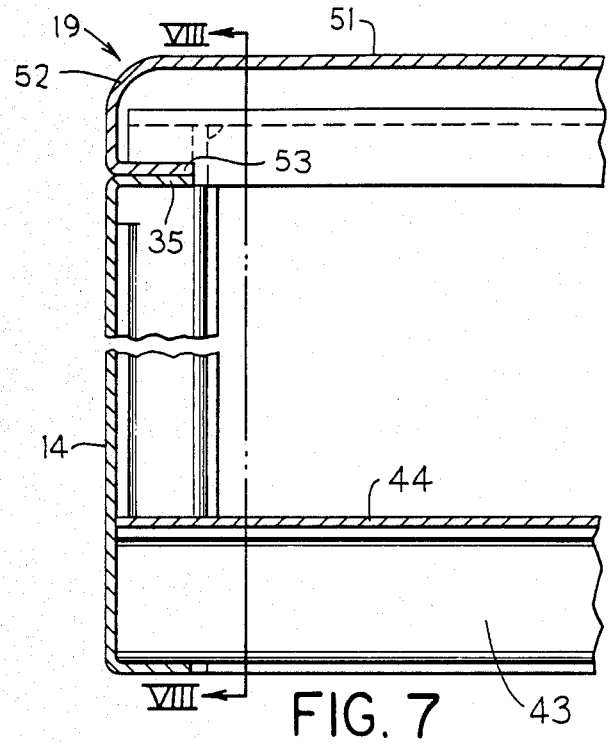
FIG. 7 ia a fragmentary sectional view of the housing structure as taken substantially along line VII—VII in FIG. 1.
Figure 8:
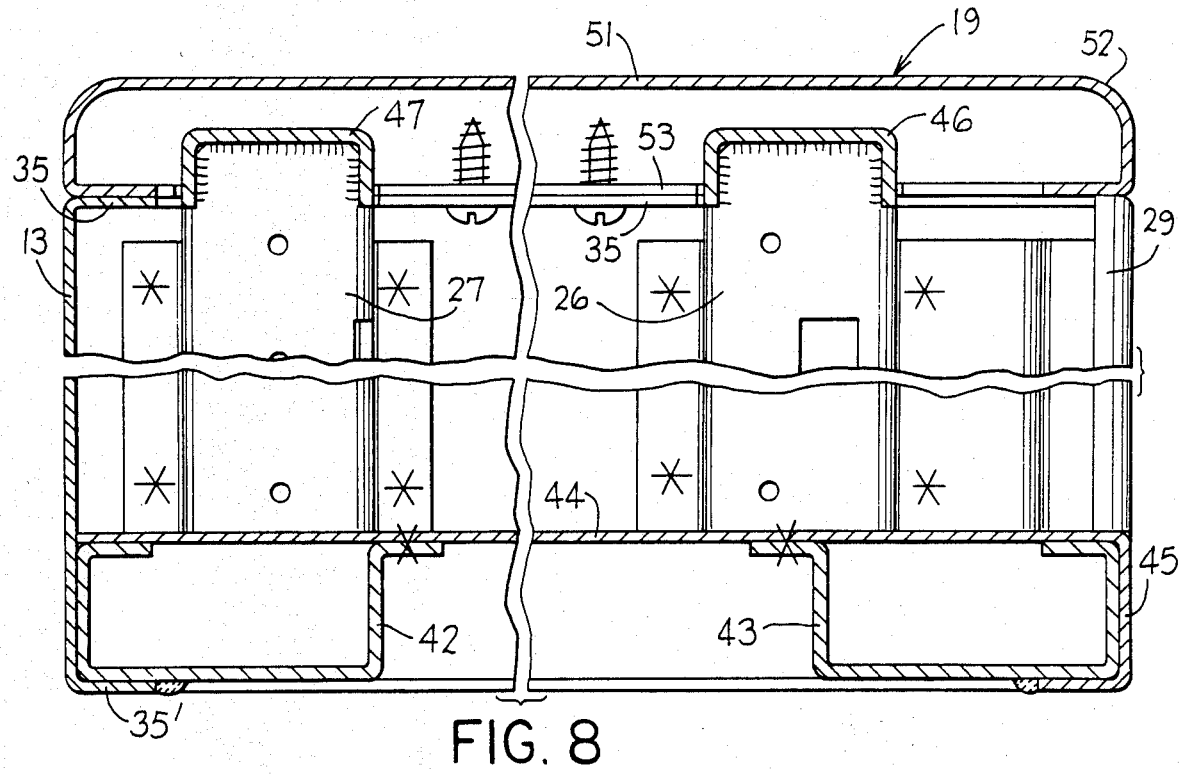
FIG. 8 is a fragmentary sectional view as taken substantially along line VIII—VIII in FIG. 7.

The side walls 14 and the rear wall 15, together with the channels 26 and 27 secured thereto, define an upright side wall structure 32 which is U-shaped in cross section, which side wall structure 32 is closed at the upper and lower ends thereof by the top and bottom wall structures 19 and 21, respectively. This side wall structure 32 is formed so that the side walls 14, the back wall 15 and the front wall strips 17 are all integrally part of a single piece of thin metal sheet or plate 33, which sheet 33 is in a substantially flat condition during the assembly stage as illustrated by FIGS. 3 and 4.

To initiate the fabrication of the side wall structure 32, a thin planar sheet of metal, particularly steel, is formed or cut to the appropriate size, which sheet when cut to the appropriate size is of a large substantially rectangular shape. The upper edge of the flat sheet 33 is initially punched and bent to form a small flange 35 which effectively extends longitudinally across substantially the complete width of the flat sheet 33 and projects inwardly in substantially perpendicular relationship thereto. This flange 35 has four substantially rectangular recesses 36 punched therefrom, which recesses project inwardly from the free edge of the flange and extend over a majority of the length of the flange toward the flat sheet. These recesses 36, at their inner ends, terminate in a rounded or V-shaped notch 37, which notch 37 continues inwardly through a further extent so as to terminate substantially flush with the flat sheet 33. Two of these notches 37 are disposed adjacent the vertical edges of the sheet so as to align with the front corners 16, and the other two notches 37 are respectively positioned inwardly equal distances from the free vertical side edges of the sheet 33 so as to align with the rounded rear corners 15. The flange 35 also has suitable openings 38 therethrough for passage of fasteners which secure to the top structure 19. A similar but small flange 35' is bent inwardly from the lower free edge of sheet 33, which flange 35' has four notches 37' therein respectively vertically aligned with the notches 37. The notches 37,37' can be formed either before or after bending of the flanges 35,35'.

After being thus formed, the flat sheet 33 then has the opposite vertical edges thereof subjected to forming operations which create two bends therein which extend longitudinally along each edge. The one rounded bend which is aligned with the outer pair of notches 37,37' results in formation of the front round corner 16 followed by the front edge strip 17, and the second sharp bend results in the formation of the inwardly extending front flange 29 at the free edge of the sheet 33.

Thereafter, the preformed channels 26 and 27 are positioned on and welded to the sheet 33 while the latter is still effectively in a planar or flat condition. For example, the front channels 26 are positioned in parallel relationship directly adjacent the opposite formed free edges of the sheet 33 and are appropriately spot welded (as at 34) to the inner surface of the sheet 33. The rear channels 27 are also positioned in parallel relationship to one another and to the channels 26 so that the rear channels 27 are disposed between the front channels 26. The rear channels are similarly spot welded to the inner surface of the sheet 33 while the latter is still in its flat or planar condition. To assist in the positioning of the channels 26 and 27, the upper flange 35 is appropriately notched and effectively defines outwardly projecting tongues 38, one of which fits into each of the channels 26 and 27 adjacent the upper end thereof to facilitate the positioning of the channels on the flat sheet 33.

Figure 2:
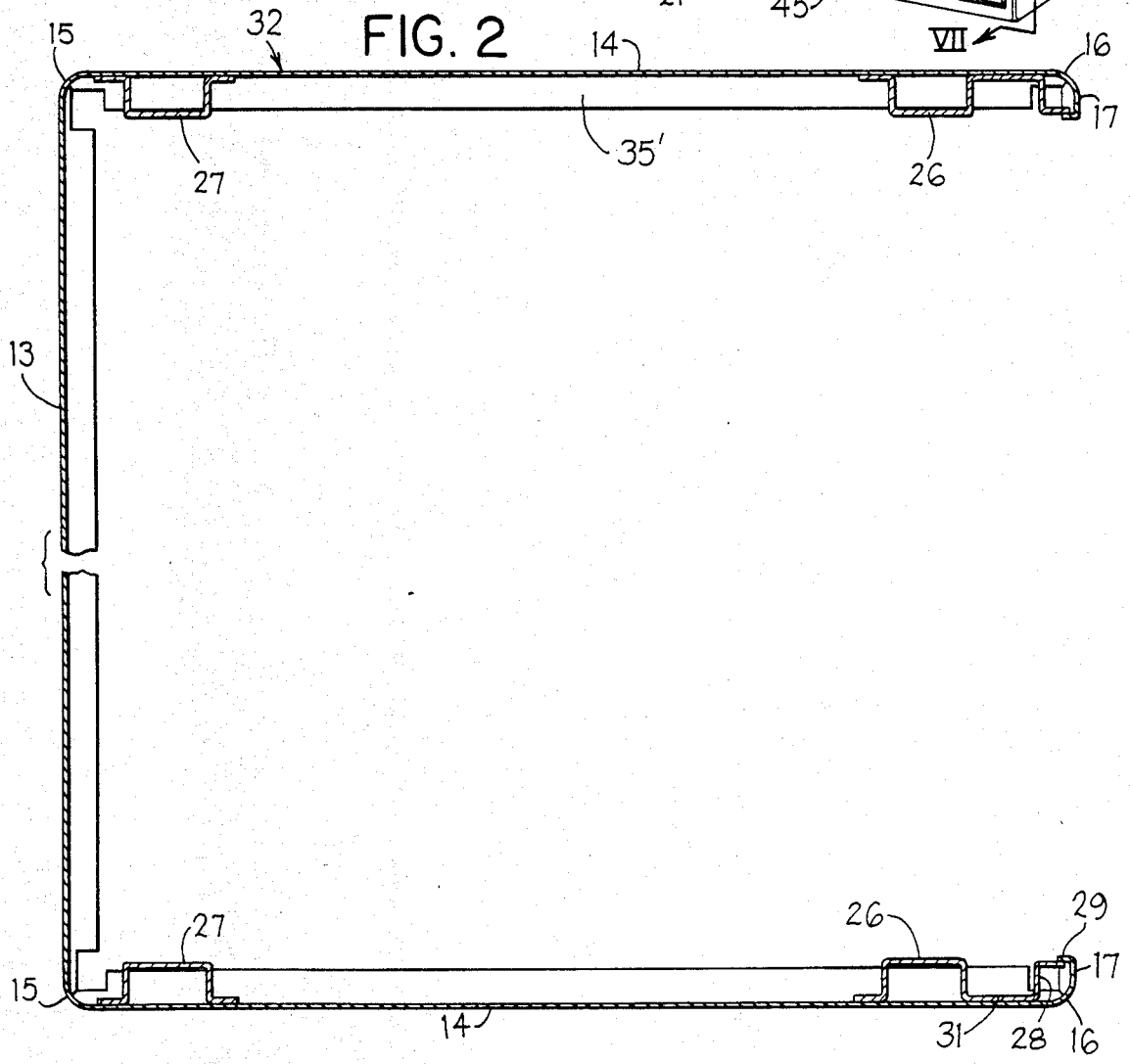
FIG. 2 is a horizontal cross-sectional view showing the configuration of the fabricated side wall structure.
Figure 6:
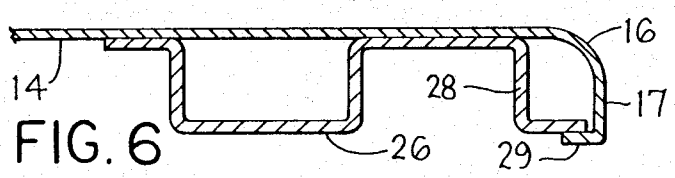
FIG. 6 is an enlarged, fragmentary sectional view taken substantially along line VI—VI in FIG. 3.

After all of the channels have been appropriately welded to the substantially planar sheet 33, the sheet 33 is subjected to further bending operations substantially along the dotted lines 39, which dotted lines extend parallel with but are spaced inwardly a small distance from the rear channels 27 and are substantially aligned with the inner pairs of notches 37–37'. This bending operation along the imaginary lines 39 results in the forming of the rear rounded corners 15 of the housing, and hence results in the side wall structure 32 assuming the U-shaped configuration illustrated by FIG. 2. The U-shaped side wall structure 32 is now ready to have the top and bottom wall structures secured thereto.

The bottom wall structure 21 extends across and is fixedly secured to the lower edge of the U-shaped side wall structure 32. For this purpose, the bottom wall structure 21 includes a pair of widthwise-extending front and rear channels 42 and 43, the latter extending parallel with the rear wall 13 of the housing and substantially flush with the lower edge thereof. These channels are welded to the side and rear walls of the housing. A substantially planar and horizontal base plate 44 overlies and is spot welded to the channels 42 and 43, which base plate 44 effectively extends across the horizontal interior cross-sectional dimension of the side wall structure 32. The base plate 44 has a front flange 45 which projects downwardly for covering the channels 42–43, which flange 45 is flush with the vertical front edge walls 17 and effectively defines the lower border of the cabinet opening 18.

The upper end of the side wall structure 32 also has the side walls 14 thereof rigidly joined together. For this purpose, the upper ends of the vertical channels 26 and 27 project upwardly a small extent beyond the top flange 35. These upwardly projecting ends are rigidly joined together by horizontally extending front and rear top channels 46 and 47, respectively. These top channels 46 and 47 extend parallel to one another so that the front channel 46 is rigidly joined to the upwardly projecting ends of the side channels 26, as by being welded thereto, and the rear top channel 47 similarly extends between and is welded to the upwardly projecting ends of the rear channels 27. These top channels 46 and 47 are disposed substantially flush with and project upwardly from the top flange 35 so as to not interfere with the interior of the U-shaped side wall structure as defined below the flange 35.

The top wall structure 19 is preferably formed in one piece from a flat thin sheet of metal plate, and for this purpose the top wall structure 19 includes a main substantially planar and horizontally extending top wall 51. The sheet forming the top wall structure 19 is subjected to a suitable forming operation so that the front, rear and side edges of the top wall 51 are suitably provided with rounded downwardly projecting corners 52. These corners 52 are smoothly rounded so as to extend through an angle of about 90°, and these rounded corners 52 at their lower ends are in turn sharply bent inwardly substantially at 90° so as to form an inwardly projecting flange 53. This latter flange 53 directly overlies the top flange 35 of the side wall structure. Flange 53 has openings therein which align with the openings 41 of flange 35, whereby fasteners such as screws or bolts can then be inserted through the aligned openings of flanges 35 and 53 so as to fixedly but removably secure the top wall structure 19 to the upright side wall structure 32.

With the resulting housing structure as described above, there is thus provided an arrangement which is highly desirable in appearance from all directions inasmuch as the outer side skin of the side wall structure 32 is integrally formed in one piece and provides the rounded back and front corners 15 and 16, respectively, whereby the rounding of the corners provides not only a desirable appearance, but also makes the corners free of seams or weld lines, and hence the back of the cabinet provides a desirable appearance so as to permit the cabinet to be used in a free-standing environment where exposure of the back is permitted. The forming of this one-piece side skin for the side wall structure, and the fact that welding of the support rails or channels 26 and 27 occurs when the side wall skin is still in a substantially flat condition, greatly facilitates the fabrication of the housing structure and particularly facilitates the welding operations.

The corners 15, 16 and 52 are all preferably of about $\frac{3}{8}$ inch radius. In addition, the housing structure of this invention normally has a width in the range of about 30 to 48 inches, and a depth in the range of about 16 to 30 inches.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method of forming a housing structure for an upright free-standing cabinet, comprising the steps of:

providing a planar and enlarged substantially rectangular sheet of thin metal;

forming four opposed pairs of notches in the top and edges of the sheet;

bending the upper and lower edges of said sheet to form inwardly projecting top and bottom flanges;

bending each side edge of said sheet substantially along one pair of said notches to form a rounded flange which extends longitudinally along said side edge;

positioning a first pair of elongated support rails on the inner surface of said sheet directly adjacent the rounded flanges, and welding said first support rails to said sheet;

positioning a second pair of elongated support rails adjacent the inner surface of said sheet so that the second support rails extend substantially parallel to but are spaced inwardly a substantial distance from said side edges, each of said second support rails being positioned in close proximity to a further pair of aligned notches as formed in the upper and lower flanges, and then welding said second rails to said sheet; and forming said flat sheet with the first and second support rails welded thereto into a substantially U-shaped configuration by bending said flat sheet to form a first rounded corner which extends longitudinally between one said further pair of aligned notches as formed in the top and bottom flanges and by bending the flat sheet to form a second rounded corner which extends longitudinally between the other said further pair of aligned notches.

2. A method according to claim 1, including the step of welding a first top rail horizontally across the upper ends of the first support rails after the sheet has been formed into said U-shaped configuration, and welding a second top rail horizontally across the upper ends of the second support rails.

3. A method according to claim 2, including the step of forming a top wall from a single thin sheet of metal by deforming the edges to form rounded edge portions which extend longitudinally along each edge of the top wall and terminate in inwardly projecting edge flanges, and positioning said top wall on the upper edge of the U-shaped wall structure so that the edge flanges overlap said top flange, and securing said top wall to said U-shaped configuration by means of removable fasteners which extend between the overlapping edge and top flanges.

* * * * *